United States Patent [19]

Horikoshi et al.

[11] Patent Number: 4,941,918

[45] Date of Patent: Jul. 17, 1990

[54] SINTERED MAGNESIUM-BASED COMPOSITE MATERIAL AND PROCESS FOR PREPARING SAME

[75] Inventors: Eiji Horikoshi, Atsugi; Tsutomu Iikawa, Kawasaki; Takehiko Sato, Yokohama, all of Japan

[73] Assignee: Fujitsu Limited, Kawasaki, Japan

[21] Appl. No.: 282,506

[22] Filed: Dec. 12, 1988

[30] Foreign Application Priority Data

| | | | |
|---|---|---|---|
| Dec. 12, 1987 | [JP] | Japan | 62-313142 |
| Apr. 12, 1988 | [JP] | Japan | 63-089489 |
| Apr. 13, 1988 | [JP] | Japan | 63-090927 |

[51] Int. Cl.[5] ..... B22F 1/00

[52] U.S. Cl. ..... 75/229; 75/232; 75/235; 75/238; 75/244; 419/2; 419/13; 419/14; 419/17; 419/19; 419/24; 419/31; 419/34; 419/39; 419/45; 419/57

[58] Field of Search ..... 75/229, 244, 232, 235, 75/238; 419/2, 14, 19, 13, 17, 57, 24, 45, 31, 39, 34

[56] References Cited

U.S. PATENT DOCUMENTS

| | | | |
|---|---|---|---|
| 3,216,824 | 11/1965 | Boghen et al. | 75/206 |
| 3,775,530 | 11/1973 | Lawrence et al. | 264/257 |
| 4,615,733 | 10/1986 | Kubo et al. | 75/229 |
| 4,664,704 | 5/1987 | Dohnomoto et al. | 75/229 |
| 4,749,545 | 6/1988 | Begg et al. | 419/13 |

FOREIGN PATENT DOCUMENTS

| | | |
|---|---|---|
| 0240251 | 10/1987 | European Pat. Off. . |
| 2657685 | 3/1978 | Fed. Rep. of Germany . |
| 52-98716 | 8/1977 | Japan . |
| 55-161495 | 12/1980 | Japan . |
| 57-47843 | 3/1982 | Japan . |
| 57-169036 | 10/1982 | Japan . |
| 57-169037 | 10/1982 | Japan . |
| 57-169039 | 10/1982 | Japan . |
| 58-46521 | 10/1983 | Japan . |
| 59-208042 | 11/1984 | Japan . |
| 61-231133 | 10/1986 | Japan . |

OTHER PUBLICATIONS

Patent Abstracts of Japan, vol. 7, No. 209 (C-186), Sep. 14, 1983 & JP-A-58 107 435 (Nippon Denso K.K.) 27-06-1983.

Patent Abstracts of Japan, vol. 10, No. 128, C-345, May 13, 1986 & JP-A-60 251 247 (Kogyo Gijutsuin) 11-1-2-1985.

B. A. Mikucki et al.: "Magnesium Matrix Composites at Dow: Status Update", *Light Metal Age, Oct., 1986,* pp. 16-20.

*Primary Examiner*—Stephen J. Lechert, Jr.

*Attorney, Agent, or Firm*—Staas & Halsey

[57] ABSTRACT

A magnesium-based composite material having improved mechanical strength, and in particular an improved modulus of elasticity, and a relatively low density. The material is provided by pressing and sintering a mixture of magnesium or magnesium-based alloy particles or a particulate combination of magnesium particles and particles of one or more additional metals, with a reinforcement additive of boron, or boron-coated $B_4C$, $Si_3N_4$, SiC, $Al_2O_3$ or MgO particles.

20 Claims, 6 Drawing Sheets

6 wt % Al 9 wt % Al

SINTERED MAGNESIUM-BASED COMPOSITE MATERIAL AND PROCESS FOR PREPARING SAME

BACKGROUND OF THE INVENTION

1. Field of the Invention

The present invention relates to a sintered magnesium-based composite material and a process for preparing the same.

2. Description of the Related Art

Magnesium alloys have attracted attention as lightweight high mechanical strength metals useful in connection with aircraft and space equipment and components and electronics equipment and components.

In the field of electronics equipment and components, mechanical parts for magnetic recording, particularly head arms, are often diecast from a magnesium alloy. The important characteristics of such a material when used to form head arms include (1) low density and (2) high mechanical strength. Particularly such material should have a high Young's modulus of elasticity. Magnesium is a good candidate for such head arm applications due to its low density; however magnesium has a low Young's modulus of elasticity. Therefore, if a magnesium alloy having an increased modulus of elasticity without experiencing a substantial change in its low density is provided, for making head arms the performance of magnetic recording operations may be improved by increasing the speed of movement of the head.

Known method of improving the modulus of elasticity of a magnesium alloy involves adding a very small amount of zirconium or rare earth metal to the alloy to prevent growth of the crystal grains of the magnesium however, only this provides a modulus of elasticity of only, about 4500 kgf/mm$^2$ which is still too low for some applications.

In Japanese Unexamined Patent Publication (Kokai) No. 55-161495 published on Dec. 16, 1980, H. Inoue et al. disclose a vibrating plate for a sonic converter made of a fused alloy of magnesium and boron. Such fused or cast alloy of magnesium and boron, however, does not provide a uniform composition due to the difference between the densities of magnesium and boron, and therefore, does not provide the expected improved properties.

Sintering shape magnesium powders to obtain a shaped sintered body is also known, but such procedure does not provide bodies having a sufficient Young's modulus of elasticity.

SUMMARY OF THE INVENTION

The above-mentioned problems, i.e. the low Young's modulus of elasticity of magnesium, and the nonuniform distribution of reinforcement additives in fused or cast magnesium alloys and composites, is solved through the use of the present invention, which provides a sintered magnesium-based composite material comprising a magnesium or magnesium-based alloy matrix and a boron containing reinforcement additives dispersed in the matrix, and wherein the additive comprises boron itself or boron-coated particles of boron carbide, silicon nitride, silicon carbide, aluminum oxide or magnesium oxide.

DESCRIPTION OF THE PREFERRED EMBODIMENTS

Figure 1:
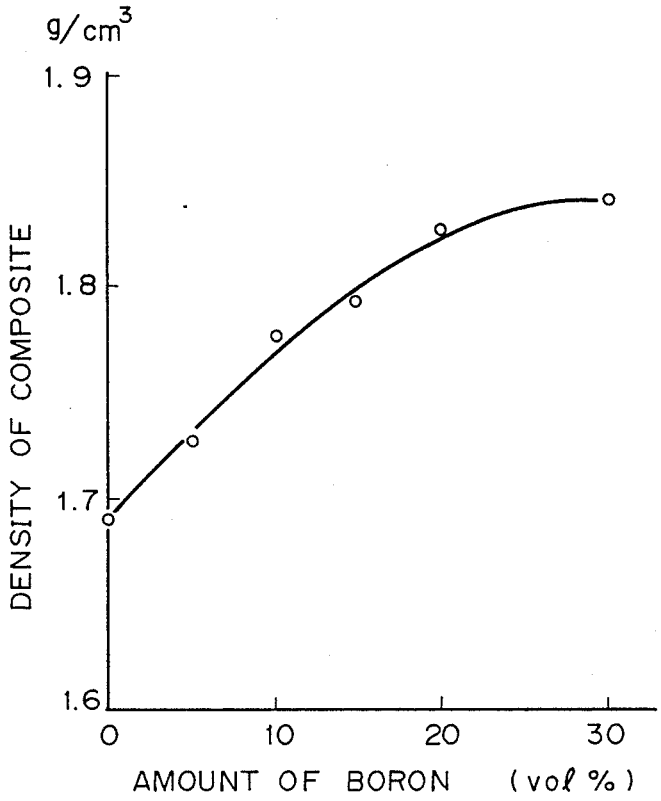
FIG. 1 is a graph illustrating the relationship between the density of the magnesium-boron composite and the amount of boron added.

The above and other aspects of the present invention are described hereinbelow with reference to the accompanying drawings, and by way of examples.

To improve the modulus of elasticity of magnesium or magnesium alloys without substantial change in the low density thereof, a composite material may be formed of a material having a low density ($\rho$) and a high modulus of elasticity (E). Materials having such properties are shown in Table 1, which also shows the properties of magnesium itself for comparison.

TABLE 1

| Material | Density (g/cc) | Modulus of elasticity (kgf/mm$^2$) |
|---|---|---|
| Magnesium | 1.74 | $4.5 \times 10^3$ |
| Boron | 2.55 | $4.0 \times 10^4$ |
| Boron carbide | 2.52 | $4.6 \times 10^4$ |
| Silicon nitride | 3.10 | $3.5 \times 10^4$ |
| Silicon carbide | 3.12 | $5.0 \times 10^4$ |
| Aluminum oxide | 3.99 | $3.7 \times 10^4$ |
| Magnesium oxide | 3.65 | $2.5 \times 10^4$ |

Of the materials shown in Table 1, boron is the preferred material since it does not react readily with magnesium and does not mechanically weaken the composite. Conversely, boron carbide, silicon nitride, silicon carbide, aluminum oxide, and magnesium oxide all are reactive with magnesium to form a mechanically weak composite product, resulting in a mechanically weakened composite or one having defects therein. Nevertheless, particles of boron carbide ($B_4C$), silicon nitride ($Si_3N_4$), silicon carbide (SiC) aluminum oxide ($Al_2O_3$), or magnesium oxide (MgO) may be used as reinforcement additives for magnesium, without the above-mentioned problems, if the surfaces of such particles are first coated with boron.

Accordingly, the reinforcement additive used in accordance with the present invention may be boron itself or may comprise boron-coated particles of boron carbide, silicon nitride, silicon carbide, aluminum oxide, or magnesium oxide. And such reinforcement particles may be in any form, such as, for example, powder, whiskers, or short fibers. The size of the reinforcement particles is not particularly critical, but preferably, the maximum size of the reinforcement particles may range from 0.1 $\mu$m to 1 mm, and more preferably from 0.1 $\mu$m to 100 μm. The sintered object may include up to about 50% by volume of the reinforcement additive dispersed in a magnesium matrix obtained by sintering magnesium powders. Preferably, however, the object should contain from 2 to 30% reinforcement additive by volume, more preferably from 2 to 25%, by volume and most preferably, from 4 to 20% by volume, to achieve the desired improvement of mechanical strength without substantially changing the density of the product.

The coating of the reinforcement particles, with boron can be carried out using any suitable method, although a gas phase deposition method such as CVD, sputtering, or evaporation is most convenient. As described above, boron is most preferable from the viewpoint of it's inert nature relative to magnesium, but boron is a relatively expensive material accordingly boron-coated materials such as silicon nitride or the like advantage of lower cost.

The magnesium or magnesium-based alloy materials for forming the matrix are not particularly limited, in that magnesium-aluminum systems (particularly those containing 3–12 wt% Al), magnesium-aluminum-zinc systems (particularly those containing 3–9 wt% Al and 0.1–3.0 wt% zinc), and magnesium-zirconium-zinc systems may all be used as a magnesium-based alloy for forming the improved composites of the invention.

The magnesium-based composites of the present invention are prepared by sintering a mixture of particles of magnesium-based materials and reinforcement additive particles. Sintering is advantageous in that it facilitates the uniform distribution of the boron-based reinforcement particles in the matrix by first forming a mixture of magnesium particles and reinforcement particles and then shaping the mixture to present a shape close to the desired final shape. This allows a uniform distribution of the boron-based reinforcement additive in the matrix of the final shaped and sintered product.

In another aspect of the present invention, a process is provided for preparing a sintered magnesium-based composite material. The process comprises the steps of; preparing a mixture of magnesium or magnesium-based alloy particles or of a combination of magnesium particles and particles of one or more additional metals with reinforcement additive particles comprising boron itself or boron-coated particles of boron carbide, silicon nitride, silicon carbide, aluminum oxide or magnesium oxide, the reinforcement additive particles comprising 2 to 30% by volume of the mixture; pressing the mixture at a pressure of 1 to 8 tons/cm$^2$ to form a shaped body; and heating the shaped body at a temperature of 550° to 650° C. in an inert atmosphere to cause sintering to occur to thereby produce a sintered magnesium-based composite material. The sintered magnesium-based composite material may be further subjected to an HIP treatment to increase the density thereof.

The particles of magnesium or of a magnesium-based alloy or of the combination of particles of magnesium and mixture of magnesium other metal(s) may have a particle size ranging from 0.1 to 100 μm. Combination of particles comprises a mixture of magnesium with another metal or metals by which a alloy is formed as a result of the sintering process.

A pressing may be carried out in the conventional manner.

The sintering of the shaped body is carried out in an inert atmosphere, for example, under an argon or helium gas flow of 1 to 10 l/min, at a temperature of 550° to 650° C., for 10 minutes to 10 hours or more. A relative density of 95 to 98% may be obtained by this sintering process. For samples sintered at about 600° C., which exhibit the highest modulus of elasticity, the structure is relatively dense and necking among the particles occurs. However, when sintering occurs at 500° C., the structure is less dense. At a sintering temperature of 650° C., the structure is too coarse to be strengthened.

In a further aspect of the present invention, there is provided a process for preparing a sintered magnesium-based composite material, comprising the steps of: pressing a batch of mgnesium-based particles to form a shaped, porous magnesium-based body; heating the porous shaped body in an oxidizing atmosphere to form a sintered magnesium-based body containing magnesium oxide therein; and subjecting the sintered plastic deformation processing to increase the relative density of the sintered magnesium-based body as a result of reinforcement by the magnesium oxide.

In the foregoing process, the sintered magnesium-based body containing magnesium oxide therein is subjected to a plastic deformation process to increase the relative density thereof, and as a result, the magnesium matrix and the magnesium oxide therein are formed into a composite without heating or reaction therebetween, i.e., without mechanically weakening the composite.

The starting magnesium-based particles may comprise particles of magnesium or of a magnesium alloy, or of a particulate mixture of magnesium and one or more additional metal capable of forming a magnesium alloy. The magnesium-based particles typically have a size in the range of 1 to 100 μm.

The pressing is carried out at a pressure of 0.5 to 4 tons/cm$^2$ to form a porous body having a relative density of 50% to 93%, and the sintering is carried out at a temperature of 500° to 600° C. in an oxidizing atmosphere, for example, an argon atmosphere containing 50 to 1000 ppm of oxygen, for 10 minutes to 10 hours.

The plastic deformation of the sintered body may be carried out for example, by pressing, rolling swagging, etc.; for example, the body may be pressed at a pressure of 1 to 8 tons/cm$^2$.

According to the present invention, the magnesium-based material of the invention improved mechanical strength, and in particular has an improved increase in its modulus of elasticity, and has suffered no substantial increase in its density, as shown in the following Examples. The sintered magnesium-based composite material according to the present invention has an additional advantage in that the thermal expansion coefficient thereof can be adjusted by appropriate selection of the composition of the composite. This capability thermal expansion coefficient adjustment prevents mismatching of the thermal expansion coefficient of the head arm with that of the recording disc, so that deviation of the head from tracks formed on a disc of e.g., aluminum, can be prevented.

The present invention will now be described by way of Examples, which are not intended to limit the scope of the invention other than as claimed.

EXAMPLES

EXAMPLE 1

A powder mixture of Mg-9 wt% Al was prepared by first mixing a −200 mesh magnesium powder and −325 mesh aluminum powder and a boron powder (average particle size of 20 μm was mixed with the Mg-Al powder mixture in amounts ranging from 0 to 30% by volume.

The resultant powder mixtures were pressed at 4 tons/cm$^2$ to form tensile sample test pieces, and the sample test pieces were sintered in an argon atmosphere at 560°-620° C. for 1 hour.

The density, the modulus of elasticity (Young's modulus), the tensile strength, and the thermal expansion coefficient of each of the resultant sintered bodies was evaluated, and the results are as shown in FIGS. 1 to 4.

Figure 2:
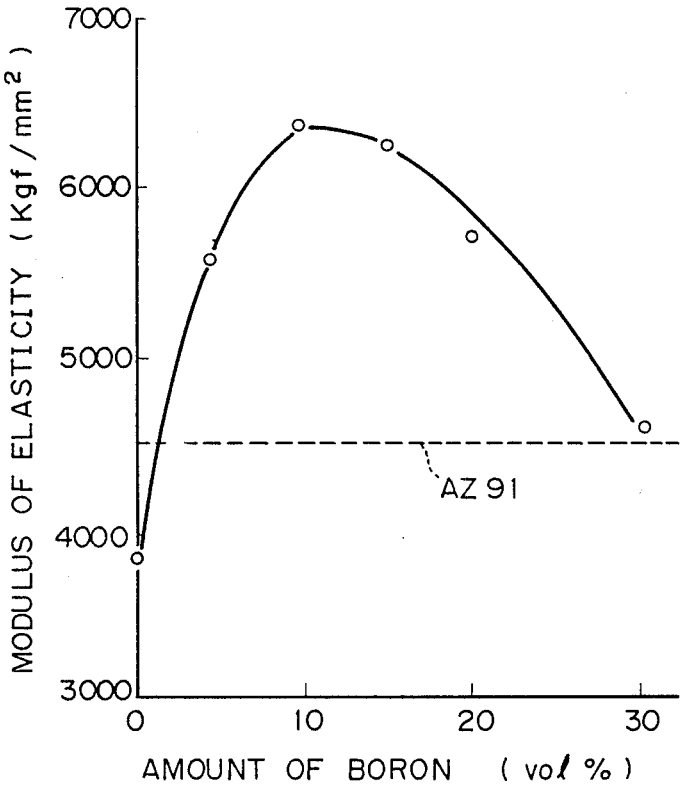
FIG. 2 is a graph illustrating the relationship between the modulus of elasticity of the Mg-B composite and the amount of boron added.
Figure 3:
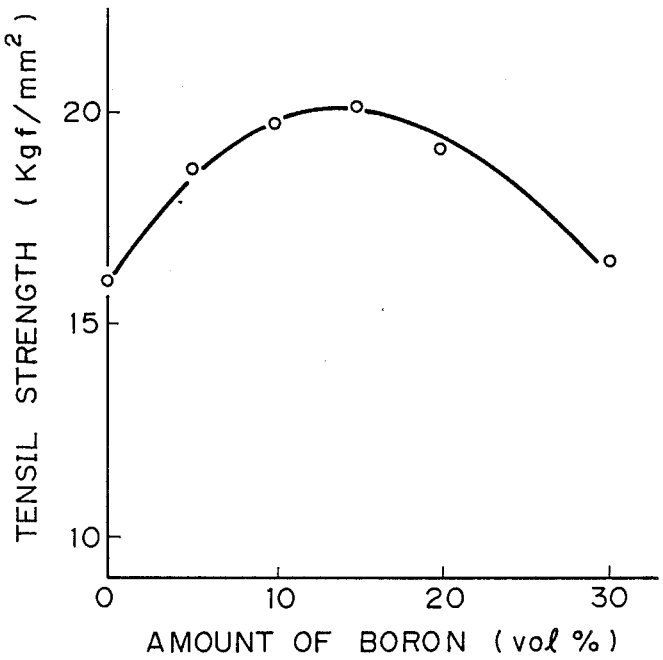
FIG. 3 is a graph illustrating the relationship between the tensile strength of the Mg-B composite and the amount of boron added.
Figure 4:
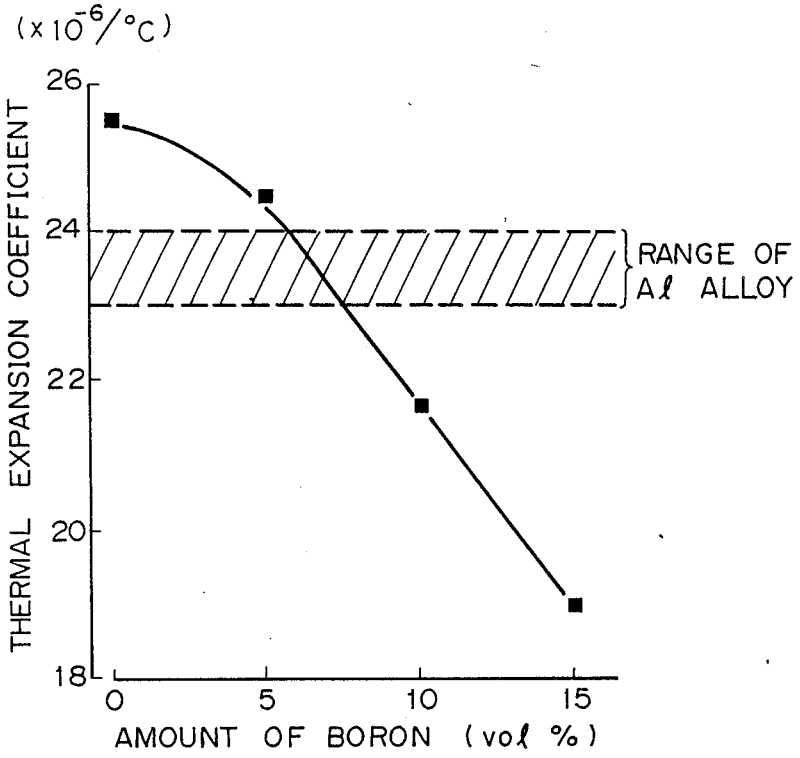
FIG. 4 is a graph illustrating the relationship between the thermal expansion coefficient of the Mg-B composite and the amount of boron added.

In FIGS. 1 to 4, the density of the composite material in each sintered body was 1.8 g/cm$^3$ at most, which is almost the same as the 1.83 g/cm$^3$ density of a conventionally used magnesium alloy for a head arms (AZ91: a magnesium alloy with 9 wt% Al and 1 wt% Zn). On the other hand, the modulus of elasticity was improved to 6300 kgf/mm$^2$, 1.4 times larger than that of the AZ91 conventional magnesium alloy, and the tensile strength was 20 kgf/mm$^2$, about 2 times larger than that of the AZ91 conventional magnesium alloy. With reference to FIG. 2 it can be seen that the composite material should preferably contain 2 to 30% by volume of boron from the viewpoint of increasing the modulus of elasticity. From FIG. 4 it can be seen that the thermal expansion coefficient decreased as the amount of the boron additive was increased. When the composite material contained about 6 to 7.5% by volume of the boron additive, the composite material has a thermal expansion coefficient equivalent to that of the aluminum alloy generally used for magnetic recording disc substrates.

To determine the dependence of the modulus of elasticity of the composite on the Al content, the Al content of the B/Mg sintered composite system was varied.

To determine the optimum composition for modulus of elasticity purposes the aluminum content was varied between 0 and 18 wt%, the composition dependency of the modulus of.

Figure 5:
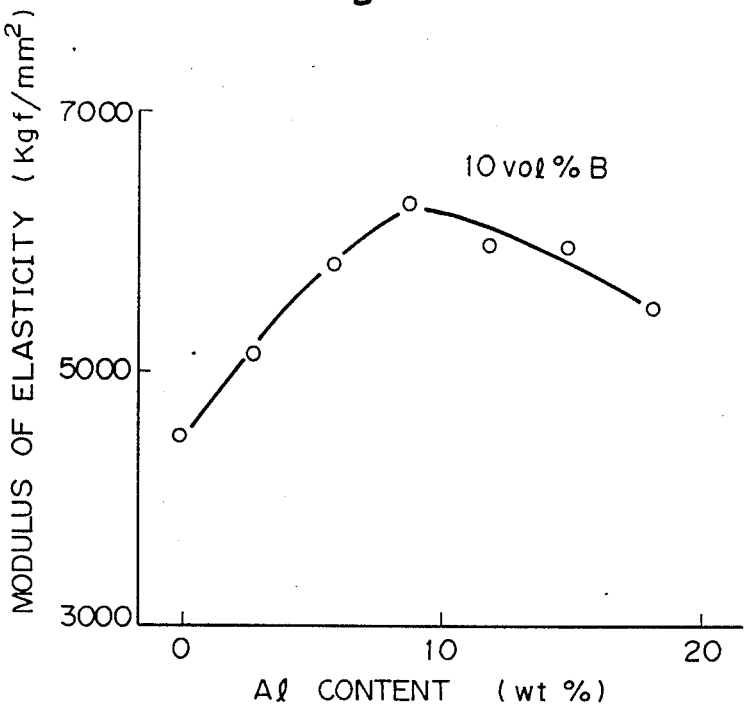
FIG. 5 is a graph illustrating the dependence of the modulus of elasticity on the aluminum content.

The dependence of the modulus of elasticity on the aluminum content of the composite material is illustrated in FIG. 5. The modulus of elasticity has a value of 6300 kgf/mm$^2$ (1.4 times higher than that of a cast Mg-Al alloy without boron) when the aluminum content is 9% by weight. By the way comparison, in the absence of the boron, the optimum aluminum content is 6% by weight.

Figure 6A:
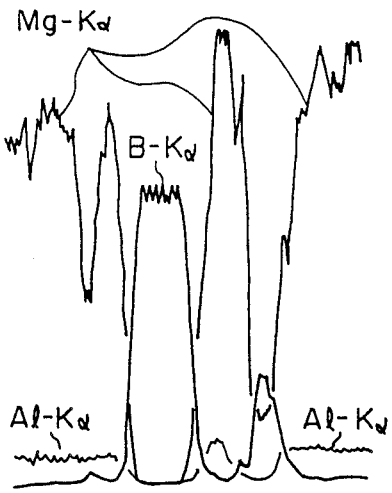
FIGS. 6A and 6B are charts illustrating the results of XMA analysis of samples containing 6; and 9 percent Al by weight and 10 percent B by volume.
Figure 6B:
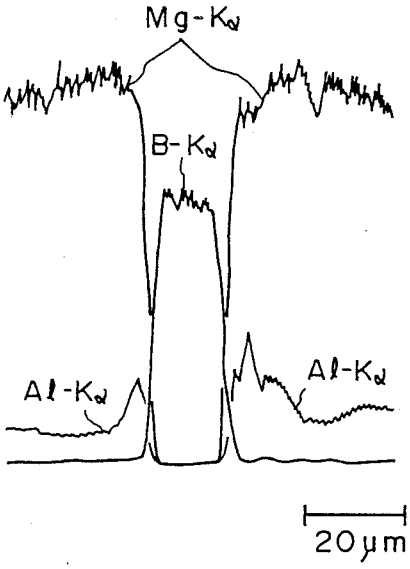

FIGS. 6A and 6B show the results of XMA analysis for samples containing 6 and 9 percent Al by weight, and 10 percent B by volume. Both samples have a uniform distribution of Al and Mg in the matrix. However, the sample containing 9% Al by weight has an aluminum-rich layer several microns in thickness around the boron particles. This concentration of aluminum around the boron particles may promote good boron-magnesium interface bonding, resulting in a B/Mg-Al alloy with a high modulus of elasticity. This aluminum concentration may explain the differences in the optimum aluminum content for the samples with or without boron.

Thus magnesium-aluminum sintered alloy, reinforced with boron particles and has an increased modulus of elasticity has been developed. Light weight magnesium-aluminum alloys have proven to be viable candidates for high-speed moving components used in computer peripherals. The modulus of elasticity, in composite materials is improved by the inclusion of boron particles which reinforce the alloy matrix.

Sintering in argon or helium near the temperature near 600° C. provides optimum results for magnesium-aluminum alloys since no brittle phases are produced.

XMA analysis reveals that an aluminum-rich interface layer which forms around the boron particles may promote the formation of strong bonds between the boron particulate reinforcement and the magnesium-aluminum matrix.

EXAMPLE 2

Powders of boron carbide, aluminum oxide, silicon nitride and silicon carbide, having particle sizes ranging from about 1-50 μm, were charged into respective chemical vapor deposition apparatuses, and using boron chloride ($BCl_3$) and hydrogen as a reaction gases and a temperature of 800° to 1000° C., the following chemical reaction was caused to occur for 10 minutes to thus obtain a coating of boron having a thickness of 1 to 3 μm: on the particles $$2BCl_3 + 3H_2 \rightarrow 2B + 6HCl$$

The coated powders were mixed with a −200 mesh magnesium alloy (Mg-9 wt% Al) particles in an amount of 10% by volume of the coated powders based on the total volume of the mixture. The obtained mixtures of powders were pressed at 4 tons/cm$^2$ and sintered in an argon atmosphere at 600° C. for 1 hour.

The densities, the moduli of elasticity, and the tensile strengths of the resultant samples were then evaluated, and the results were shown in Table 2.

TABLE 2

| Reinforcing Material | Density (g/cm$^3$) | Modulus of Elasticity (kgf/mm$^2$) | Tensile strength (kgf/mm$^2$) |
|---|---|---|---|
| SiC | | 6500 | 25.3 |
| $B_4C$ | | 6400 | 24.1 |
| $Al_2O_3$ | | 6200 | 24.7 |
| $Si_3N_4$ | | 6000 | 21.8 |
| B* | | 6300 | 22.5 |
| Mg** | 1.69 | 3800 | 8.0 |

*Data from a composite using 10 vol % of boron powder.
**Data from Mg-9% Al alloy.

EXAMPLE 3

A −200 mesh magnesium powder was pressed at 2 tons/cm$^2$ to form a porous magnesium shaped body having a relative density of 85%.

The porous magnesium body was heat treated in a gas flow of argon containing 200 ppm of oxygen at 500° C. for 1 hour, and the sintered magnesium body thus obtained had a magnesium oxide coating having a thickness of 0.1 to 2 μm inside the pores of the body, and the body had a relative density of 87%.

This sintered magnesium body containing magnesium oxide was pressed again at 4 tons/cm$^2$ to obtain a shaped body of a Mg-MgO composite. This composite shaped body had a relative density of 96% and the properties shown in Table 3.

TABLE 3

| Reinforcing Material | Density (g/cm$^3$) | Modulus of Elasticity (kgf/mm$^2$) | Tensile strength (kgf/mm$^2$) |
|---|---|---|---|
| Mg—MgO composite | 1.76 | 5400 | 11.5 |
| Sintered Mg | 1.69 | 3800 | 8.0 |

We claim:

1. A sintered magnesium-based composite material comprising a magnesium or magnesium-based alloy matrix and a boron containing reinforcement additive dispersed in the matrix, said additive comprising boron particles or boron-coated particles of boron carbide, silicon nitride, silicon carbide, aluminum oxide or magnesium oxide.

2. A composite material according to claim 1, wherein the reinforcement additive is in the form of a powder, whiskers or short fibers.

3. A composite material according to claim 1, wherein the reinforcement additive is present in an amount of 2 to 30% by volume of the composite material.

4. A composite material according to claim 3, wherein the reinforcement additive present in an amount of 2 to 25% by volume ranging from the composite material.

5. A composite material according to claim 4, wherein the reinforcement additive is present in an amount of 4 to 20% by volume ranging from the composite material.

6. A composite material according to claim 1, wherein the matrix comprises a magnesium-aluminum alloy.

7. A composite material according to claim 1, wherein the reinforcement additive comprises boron.

8. A composite material according to claim 1, wherein the reinforcement additive comprises boron-coated particles of boron carbide, silicon nitride, silicon carbide or aluminum oxide.

9. A composite material according to claim 1, wherein the reinforcement additive particles have a maximum size of 0.1 μm to 1 mm.

10. A composite material according to claim 9, wherein the reinforcement additive particles have a maximum size of 0.1 μm to 100 μm.

11. A process for preparing a sintered magnesium-based composite material comprising the steps of:

preparing a mixture of magnesium or magnesium-based alloy particles or of a combination of magnesium particles and particles of one or more additional metals with reinforcement additive particles comprising boron or boron-coated particles of boron carbide, silicon nitride, silicon carbide, aluminum oxide or magnesium oxide, the reinforcement additive particles comprising 2 to 30% by volume of the mixture;

pressing said mixture at a pressure of 1 to 8 tons/cm$^2$ to form a shaped body; and heating the shaped body at a temperature of 550° to 650° C. in an inert atmosphere to cause sintering to occur to thereby produce a sintered magnesium-based composite material.

12. A process according to claim 11, further comprising the step of subjecting said sintered magnesium-based composite material to HIP treatment.

13. A process according to claim 11, wherein the reinforcement additive particles are in the form of a powder, whiskers or short fibers.

14. A process according to claim 11, wherein the reinforcement additive particles have a maximum size of 0.1 μm to 1 mm.

15. A process according to claim 11, wherein the reinforcement additive particles have a maximum size of 0.1 to 100 μm.

16. A process according to claim 11, wherein the magnesium particles have a size of 1 to 100 μm.

17. A process for preparing a sintered magnesium-based composite material comprising the steps of:

pressing a batch of magnesium-based particles to form a shaped porous magnesium-based body;

heating the porous shaped body in an oxidizing atmosphere to form a sintered magnesium-based body having a coating containing magnesium oxide thereon; and subjecting the sintered magnesium body to a plastic deformation process to increase the relative density thereof as a result of reinforcement by the magnesium oxide.

18. A process according to claim 11, wherein said boron coated particles are prepared by coating particles of boron carbide, silicon nitride, silicon carbide, aluminum oxide or magnesium oxide with boron to a thickness of 1 to 3 μm using a gas vapor deposition method comprising chemical vapor deposition, sputtering or evaporation.

19. A process according to claim 11, wherein said boron coated particles are prepared by coating the particles of boron carbide, silicon nitride, silicon carbide, aluminum oxide or magnesium oxide by chemical vapor deposition using boron halide and hydrogen as the reaction gases at a temperature of 800° C. to 1000° C.

20. A process according to claim 17, wherein the porous shaped body is heated in an atmosphere comprising an inert gas containing 50 to 1000 ppm of oxygen whereby the magnesium oxide coating has a thickness of approximately 0.1 to 2 μm.

* * * * *

UNITED STATES PATENT AND TRADEMARK OFFICE

CERTIFICATE OF CORRECTION

PATENT NO. : 4,941,918

DATED : July 17, 1990

INVENTOR(S) : EIJI HORIKOSHI, TSUTOMU IIKAWA, and TAKEHIKO SATO

It is certified that error appears in the above-identified patent and that said Letters Patent is hereby corrected as shown below:

Column 1, line 34, "known" should be --A known--;
line 37, after "magnesium" insert a semicolon --;--.

Column 3, line 16, "material accordingly," should be --material. Accordingly,--;
line 18, before "advantage" insert --provide the--;
line 58, delete "mixture of magnesium";
line 59, "Combination" should be --The Combination--;
line 61, after "a" (first occurrence) insert --magnesium-based--.

Column 4, line 11, "material," should be --material--;
line 16, after "sintered" insert --magnesium-based body to--;
line 40, after "rolling" insert a comma --,--;
line 67, "powder and a" should be --powder. A--;
line 68, after "μm" insert --)--.

Column 5, line 33, after "composite" insert --material--;
line 37, "wt%, the composition dependency of" should be --wt%.--;
delete line 38 in its entirety;
line 44, "the way" should be --way of--;
line 60, after "Thus" insert a comma --,--, "alloy," should be --alloy that is--;
line 66, "elasticity," should be --elasticity--.

Column 6, line 1, "near the" should be --at a--;
line 15, delete "a" (both occurrences);
line 19, "μm: on the particles" should be --μm on the particles:--.

Column 7, line 14, "of" (first occurrence) should be --ranging from--;

UNITED STATES PATENT AND TRADEMARK OFFICE

CERTIFICATE OF CORRECTION

PATENT NO. : 4,941,918

DATED : July 17, 1990

INVENTOR(S) : EIJI HORIKOSHI, TSUTOMU IIKAWA, and TAKEHIKO SATO

It is certified that error appears in the above-identified patent and that said Letters Patent is hereby corrected as shown below:

Column 7, line 18, "of 2 to 25% by volume ranging from" should be --ranging from 2 to 25% by volume of--;
line 22, "of 4 to 20% by volume ranging from" should be --ranging from 4 to 20% by volume of--.

Signed and Sealed this

Twelfth Day of November, 1991

*Attest:*

HARRY F. MANBECK, JR.

*Attesting Officer*

*Commissioner of Patents and Trademarks*